US005872341A

United States Patent [19]

Nielsen

[11] Patent Number: 5,872,341

[45] Date of Patent: Feb. 16, 1999

[54] NOISE ATTENUATING WALL

[75] Inventor: Claus Nielsen, Vedbæk, Denmark

[73] Assignee: Erik Plinius, Lyngby, Denmark

[21] Appl. No.: 600,965

[22] PCT Filed: Aug. 25, 1994

[86] PCT No.: PCT/DK94/00320

§ 371 Date: Feb. 15, 1996

§ 102(e) Date: Feb. 15, 1996

[87] PCT Pub. No.: WO95/06167

PCT Pub. Date: Mar. 2, 1995

[30] Foreign Application Priority Data

Aug. 26, 1993 [DK] Denmark ..... 9300390

[51] Int. Cl.[6] ..... B64F 1/26; E04B 1/82

[52] U.S. Cl. ..... 181/210; 181/284; 181/286; 181/290

[58] Field of Search ..... 181/30, 210, 284, 181/286, 287, 290, 293

[56] References Cited

U.S. PATENT DOCUMENTS

| | | | |
|---|---|---|---|
| 1,845,080 | 2/1932 | Eyring et al. | 181/30 |
| 2,903,055 | 9/1959 | Merrill | 181/287 |
| 3,007,539 | 11/1961 | Brewer et al. | 181/210 |
| 3,527,010 | 9/1970 | Brzezinski | 52/513 |
| 4,114,725 | 9/1978 | Croasdale | 181/210 |
| 4,362,222 | 12/1982 | Hellstrom | 181/30 |
| 5,217,771 | 6/1993 | Schmanski et al. | 181/290 |
| 5,469,932 | 11/1995 | McNair | 181/210 |

FOREIGN PATENT DOCUMENTS

| | | |
|---|---|---|
| 2455127 | 4/1979 | France . |
| 2630762 | 4/1988 | France . |
| 2621808 | 5/1976 | Germany . |
| 3146674 | 11/1981 | Germany . |
| 469524 | 8/1989 | Sweden . |
| 645422 | 10/1979 | Switzerland . |

*Primary Examiner*—Eddie C. Lee
*Attorney, Agent, or Firm*—Dick and Harris

[57] ABSTRACT

The present invention relates to a noise screen adapted to keep down the sound from one side which is characteristic in that the vertical cross section of the noise screen (1) is zigzag-shaped, alternating between absorbing faces (2) and reflecting faces (3), and that the absorbing faces (2) are arranged on the faces tilting upwards towards the sound side. The reflecting faces (3) are preferably transparent for providing an esthetic appearance of the noise screen, but may also be non-transparent for excluding road-users from viewing inhabited areas behind the noise screen (1). The reflecting faces (3) may also in the height as well as the length of the noise screen (1) alternate between being transparent and non-transparent. The noise screen (1) is built up in modules which are placed on posts (8) which seen in cross section may be compressed respectively extended telescopically in the longitudinal direction of the noise screen (1).

6 Claims, 3 Drawing Sheets

Figure 1:
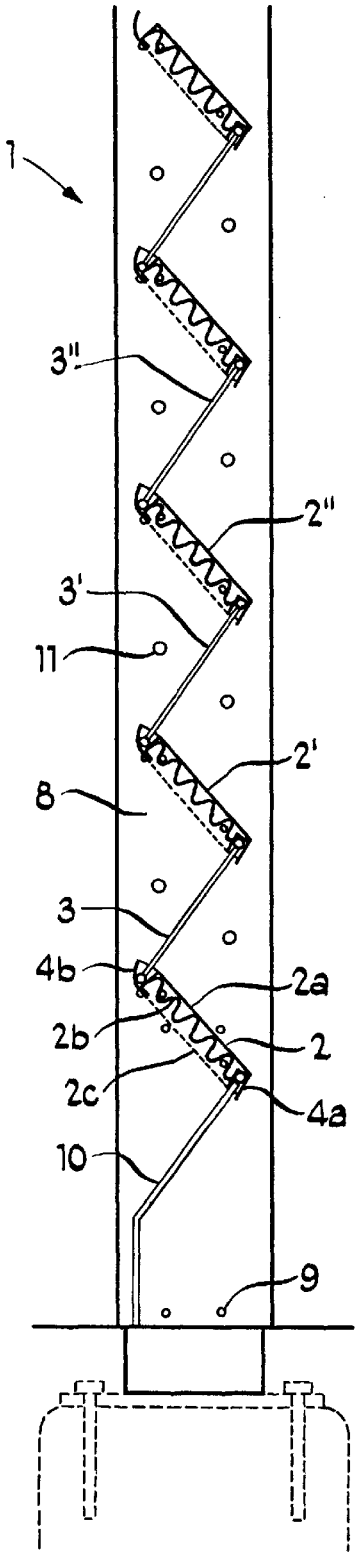

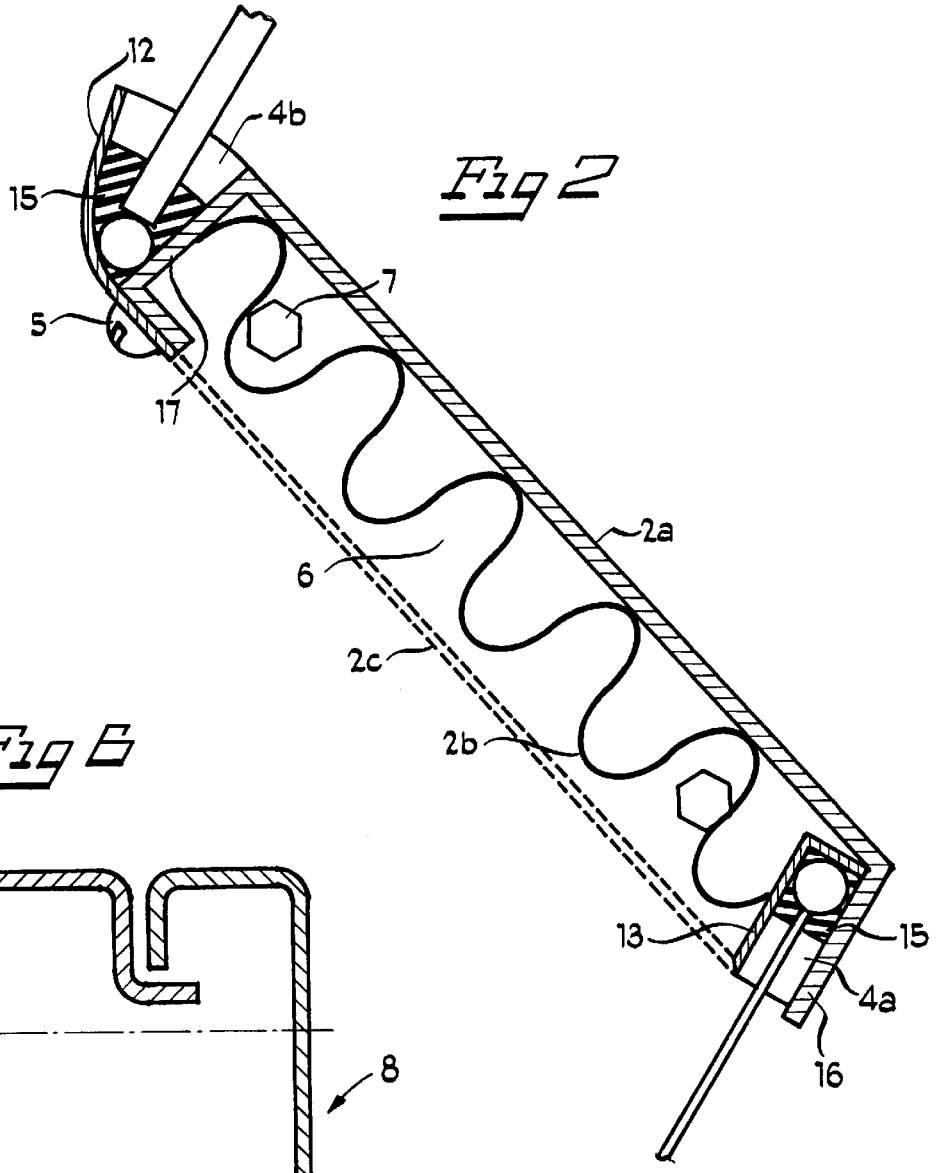
Fig 2
Fig 6
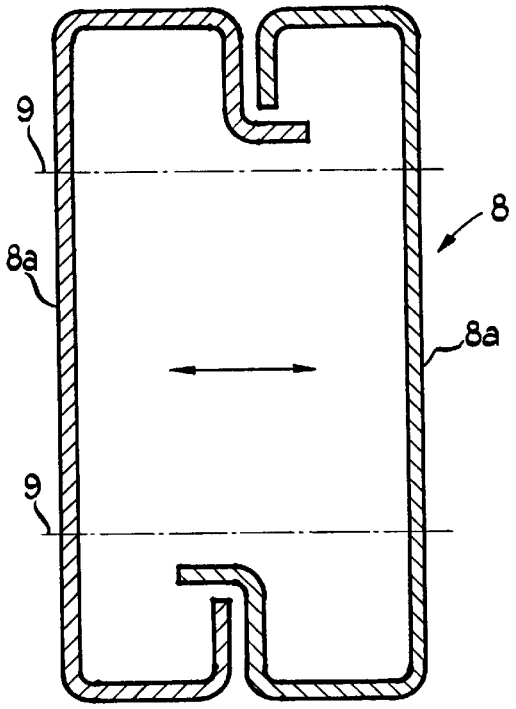

NOISE ATTENUATING WALL

The present invention relates to a noise screen adapted to keep down the sound from one side.

Noise screens are generally modular, vertical screens for use in connection with screening and/or absorption of noise/sound coming from outside by traffic installations and work places. It is particularly important that noise screens are soundproof in vertical as well as horizontal direction since any aperture in a noise screen will be penetrated by the noise.

Noise screens are known to appear in several embodiments for outdoor and indoor use in that any tight structure of materials with a weight of over 20 kg/m$^2$ has a good screening effect.

Noise absorbing screens are also known in several embodiments, for example built up as described in utility model specification DK 93 000 58 U3.

Furthermore, transparent screens are known in embodiments which are screening noise without being absorbing, as described in utility model specification DK 93 00299 U3.

Known noise screens are disadvantageous in that the vertical screen reflects the noise, for example to residents living on the opposite side of the noise source.

However, absorbing screens are known but these screens are disadvantageous in that due to the absorption material it is difficult to make them transparent and thereby they obstruct the view of the residents who are to be protected against a noise source.

It is therefore the object of the present invention to provide a noise screen which, apart from screening the area behind the noise screen from noise/sound, will also absorb the noise and thereby reduce reflections from the noise screen to the area in front of the noise screen.

This object is achieved by a noise screen of the type recited in the introduction, said noise screen according to the invention being characteristic in that the vertical cross section of the noise screen is zigzag-shaped, alternating between absorbing faces and reflecting faces, and that the absorbing faces are arranged on the faces tilting upwards towards the sound side.

Noise, such as noise from work, wheels and traffic, which is to be screened by means of noise screens, is usually emitted from a low height and spreads in a ball-shaped fashion in all directions. When the absorbing screens according to the invention tilt upwards, the absorbing faces thereof will essentially face the noise source and therefore absorb the greater part of same. The noise, which hits the reflecting faces, will be reflected towards the absorbing faces so that a substantial amount of the emitted noise is absorbed by the absorbing faces.

Accordingly, by the noise screen according to the invention there is achieved a substantial improvement of the acoustic properties thereof relative to the known noise screens.

When the reflecting faces are tilted, there is no risk either that they will reflect light from headlights of cars which might cause substantial inconvenience to traffic safety.

Advantageously, the reflecting faces are transparent and therefore provide a high degree of transmitted light, which benefits the residents living behind the noise screen so that they will not feel locked up behind a tight screen, and also assists the orientation of the road-users emitting the noise. The transparent faces also break any feeling of the road-users of driving inside a tunnel when a noise screen of the described kind has been erected on either side of the road.

In other cases, however, it is advantageous that the reflecting faces are non-transparent in view of the privacy of the residents behind the noise screen.

Finally, it is advantageous that the reflecting faces in the height of the noise screen as well as along its length alternate in an arbitrary pattern between transparent and non-transparent faces so that it is possible to break the appearance of the noise screen, which might appear monotonous by a long noise screen.

From an architectural point of view it is advantageous that the noise screen terminates with a transparent, reflecting face at its upper end in that the noise screen will thus provide an impression of being lower than the true height and additionally contribute to an esthetic appearance of the noise screen.

The absorbing faces may curve in an outward direction towards the noise source.

The absorbing faces comprise a substantially U-shaped rear plate, when seen in cross section, and a sound absorbing material arranged on the side facing the noise source, said material being kept in place by a perforated protective plate which, also seen in cross section, is substantially U-shaped, where the two U-shaped plates are mutually interlocking with the U-legs facing each other in that the upper U-leg of the rear plate in the position of use rests inside the adjacent U-leg of the protective plate, and the lower U-leg of the rear plate rests outside the adjacent U-leg of the protective plate.

By a preferred embodiment the rear plate at the upper longitudinal edge in the position of use is bent approx. 90° twice such that the end extends back towards the lower longitudinal edge substantially parallelly to the plane of the rear plate at a distance thereof, and the lower longitudinal edge is bent to form an angle the size of which depends on the tilt of the absorbing faces in the noise screen in that this lower bent end is to point down towards the upper longitudinal edge of the absorbing face placed below.

By this preferred embodiment the perforated protective plate at the lower longitudinal edge in the position of use is bent twice, the first time approx. 90°, and the second time at an angle which is somewhat bigger than 90°, the size of said latter angle depending on the tilt of the absorbing faces in the noise screen in that the section between the two bendings in the mounted position is to extend parallelly to the lower bent end of the rear plate, and at the upper longitudinal edge the protective plate is bent at an angle which is smaller than 90°.

The noise screen according to the invention is in a manner known per se built up by modules secured to vertical posts which are mounted in bases buried in the ground. For tightness along the noise screen the modules are fixedly secured to the posts, and it is therefore necessary to compensate for the changes in the length of the individual modules which are caused by temperature variations during night and day and the year.

The modules for the noise screen according to the invention are therefore mounted on posts which, seen in cross section, may be compressed respectively extended telescopically in the longitudinal direction of the noise screen.

In this connection the posts advantageously consist of two equally sized and congruent post profiles.

When the post profiles are equally sized and congruent, they may advantageously be bent from plate in such a manner that either of the post profiles has a plane face at right angles to the longitudinal direction of the noise screen, that at the first side edge of the plane face the post profile is bent approx. 90° twice such that the end extends back towards the opposite side edge of the post profile substantially parallelly to the plane face and at a distance thereof, and that apart from the said two bendings of the first side edge, the opposite second side edge is bent one more time such that the free edge extends away from the plane face substantially at right angles thereto.

Figure 3:
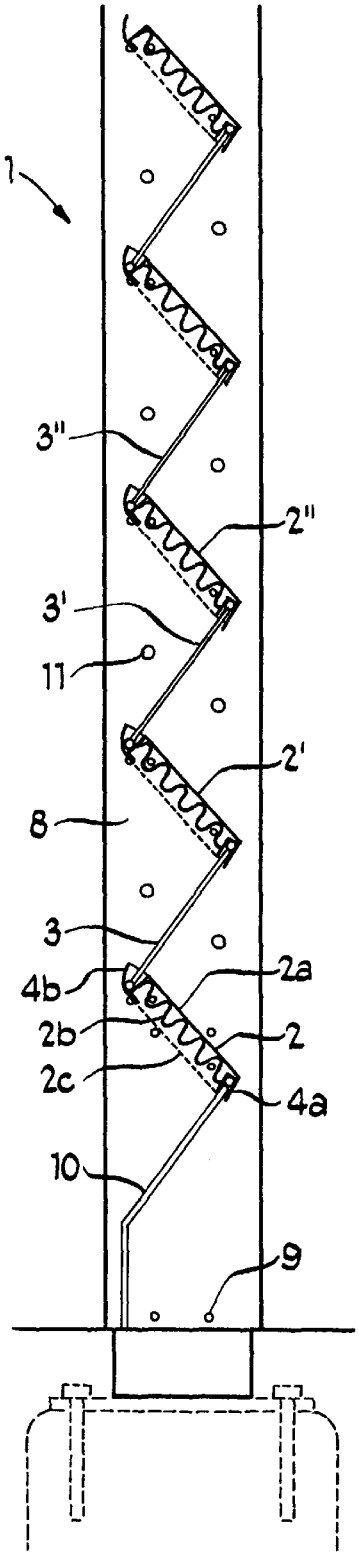
Figure 4:
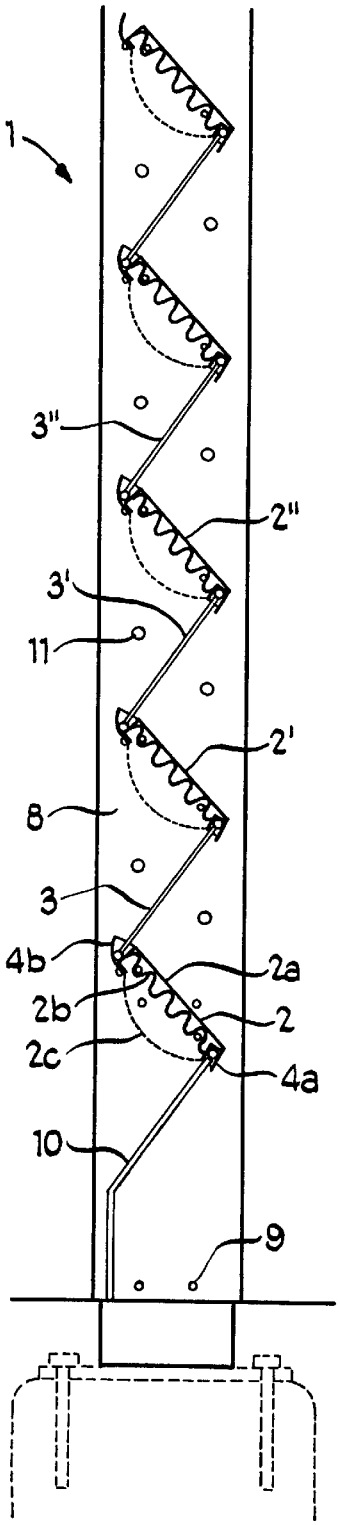
Figure 5:
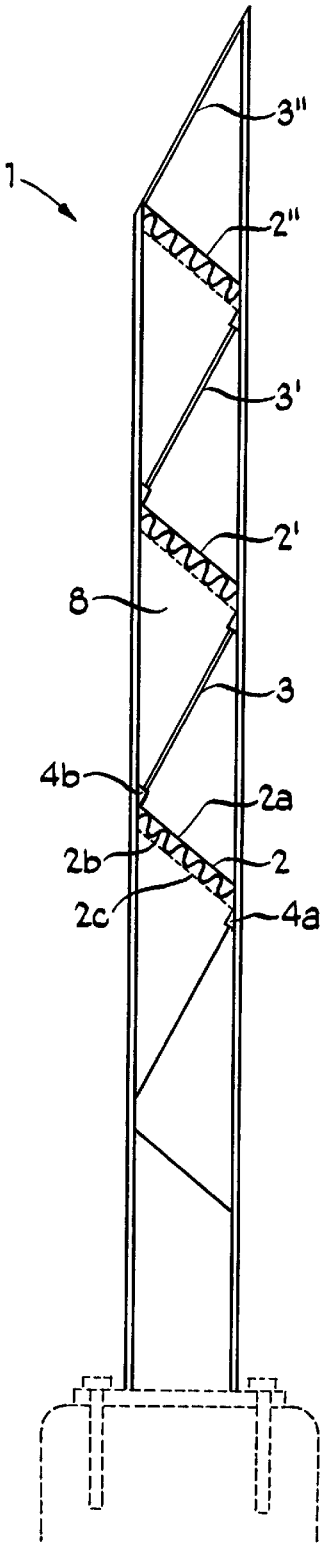

The noise screen according to the invention will be further explained in the following detailed description with reference to the drawing wherein FIG. 1 is a vertical cross section of a first embodiment of a noise screen according to the invention where the reflecting faces are transparent and the absorbing faces are plane, FIG. 2 is a cross section of an absorbing face for a noise screen according to the invention shown at a larger scale, FIG. 3 is a vertical cross section of a second embodiment of a noise screen according to the invention where the reflecting faces are non-transparent and the absorbing faces are plane, FIG. 4 is a vertical cross section of a third embodiment of a noise screen according to the invention where the reflecting faces are alternately transparent and non-transparent, and the absorbing faces curve in an outward direction towards the noise source, FIG. 5 is a vertical cross section of a fourth embodiment of a noise screen according to the invention where the reflecting faces extend upwards in a rearward direction relative to horizontal at a greater angle than 45°, whereas the absorbing faces tilt 45°, and FIG. 6 is a horizontal cross section of a post for mounting a module for a noise screen according to the invention, said post consisting of two equally sized and congruent post profiles.

Reference is first made to FIG. 1 showing a vertical section of a module for a noise screen 1 according to the invention. The module is built up by absorbing faces 2 alternating with reflecting, transparent faces 3 in such a manner that the faces 2, 3 extend mutually upwards in a zigzag-shape.

Each of the absorbing faces 2 tilt upwards and outwards in a direction towards the sound side.

By means of the transparent faces 3 it is possible to acquaint oneself with what is happening behind the noise screen, which may have implications for orientation and lighting.

Reference is now made to FIG. 2. The absorbing faces 2 are shaped by a rigid rear plate 2*a,* which on the side facing the noise source is provided with a sound absorbing material 2*b* which is kept in place by a perforated protective plate 2*c*.

The rigid rear plate 2*a* is bent from a plane plate which at the upper longitudinal edge in the position of use is bent approx. 90° twice so that the end extends back towards the lower longitudinal edge substantially parallelly to the plane of the rear plate at a distance thereof. Subsequently, the lower longitudinal edge is bent to form an angle, the size of which is smaller that 90° and depends on the tilt of the absorbing faces 2 in the noise screen in that said lower bent edge is to point down towards the upper longitudinal edge of the absorbing face 2 placed below. Accordingly the rigid rear plate includes two bent sections 10, 11.

The perforated protective plate 2*c* is bent twice at the lower longitudinal edge in the position of use, the first time approx. 90°, and the next time at an angle the size of which depends on the tilt of the absorbing faces 2 in the noise screen in that the section between the two bendings in the mounted position is to extend parallelly to the lower bent edge of the rear plate 2*a*. At the upper longitudinal edge, the protective plate 2*c* is bent at an angle which is smaller than 90°. Accordingly the perforated protective plate includes two bent sections 12, 13.

When the protective plate 2*c* is mounted on the rear plate 2*a,* as shown in FIG. 2, there is formed at the longitudinal edges thereof a slot or groove 4*a* and 4*b,* respectively, facing in opposite directions, in that the groove 4*a* has its opening downwards towards the sound side and is limited by two substantially parallel walls, and the opening of the groove 4*b* diverges upwards and away from the sound side.

By the described embodiment of the rear plate 2*a* and the protective plate 2*c* it is possible to secure the protective plate 2*c* to the rear plate 2*a* by means of a single screw 5 at either end of the protective plate 2*c*. It is thereby possible to mount and remove arbitrary faces 2 and/or 3 in the noise screen in case this should become necessary for reasons of maintenance.

The absorbing faces 2, 2', 2", . . . , and the reflecting faces 3, 3', 3", . . . , may by means of the grooves 4*a*, 4*b* be tightly connected by their longitudinal edges when a reflecting face 3 placed above is introduced with one of its longitudinal edges into the groove 4*b* in the absorbing face 2 placed below, and the opposite second longitudinal edge of the reflecting face 3 is made to rest in the bent longitudinal edge of the absorbing face 2' placed above, whereafter the subsequent protective plate 2*c'* is mounted with the screw 5 and so on in an upwards direction.

This embodiment provides for the highly important tightness of a noise screen between the absorbing faces 2 and the reflecting faces 3, in that, if so required, this tightness may be improved for example by placing sealings of rubber or a similar material 15 in the grooves 4*a* and 4*b*.

The sound absorbing material 2*b* must be a weather-resistant material which will not absorb moisture, for example 30 mm mineral wool.

The rigid rear plate 2*a* must be of a weather-resistant material, for example 3 mm hot-galvanised plate, whereas the protective plate 2*c* for example consists of 3 mm 60% perforated, hot-galvanised plate.

The reflecting and transparent faces 3 consist for example of 8 mm hardened glass or a corresponding plastic material. By the end edges the absorbing faces 2 are bent to form end walls 6 extending substantially at right angles to the plane rear plate 2*a*. The end walls 6 are provided with holes 7 for screws or similar retaining means such that the absorbing faces 2 may be tightly connected to posts 8 placed at either end of a module to support same. The acoustic tightness between the posts 8 and the end walls 6 will be improved by placing sealings between the surfaces of contact.

The absorbing faces 2 and the reflecting faces 3 are secured to the posts 8 in such a manner that they tilt 45° relative to the horizontal plane.

At the lower end, the noise screen 1 according to the invention is terminated close to the ground by means of a base unit 10 serving as a bottom reflecting face and made, for example, of hot-galvanised plate which by a longitudinal bend is divided into an upper part, which in the position of use must have the same tilt as the reflecting face 2 placed above, and a lower part, which is intended for being dug into the ground.

Reference is now being made to FIG. 3 showing a second embodiment in that the reflecting faces 3 are not transparent, but opaque, such that the area behind the noise screen cannot be seen and is protected against incident light.

The reflecting faces 3 in question consist, for example, of hot-galvanised plate or a plate of plastic which can be coloured by suitable dyes.

FIG. 4 shows a cross section of a third embodiment of a noise screen according to the invention. This embodiment differs from the embodiments shown in FIGS. 1 and 3 in that transparent as well as non-transparent reflecting faces 3 are used. It should be noted that the transparent and non-transparent faces 3 are not necessarily arranged alternately in the noise screen according to the invention.

There may accordingly below and above a given absorbing face 2 be arranged a transparent face 3 whereafter there is arranged a non-transparent face 3 after the next or the following absorbing faces 2.

It should also be mentioned that the pattern of arrangement of the transparent and non-transparent faces 3 according to the invention may vary from one module to the other in a noise screen 1 according to the invention.

It will be seen that the sound absorbing material 2*a* and the protective plates 2*c* curve outwards towards the sound side and this embodiment is also applicable in the embodiments shown in FIGS. 1 and 3.

FIG. 5 shows an embodiment wherein the reflecting faces 3 tilt upwards in a rearward direction relative to horizontal at a greater angle than 45°, for example 60°. It will be understood that also the tilt of the absorbing faces 2 may optionally depart from the shown angles and that the tilt of the absorbing faces 2 as well as the reflecting faces 3 may even vary upwards along the noise screen according to the invention.

The modules for the noise screen 1 according to the invention are mounted as stated above on posts 8 shown in a horizontal cross section in FIG. 6. Since the posts must be capable of absorbing variations in length of the modules, each of the posts is made in such a manner that it may extend respectively contract telescopically in the longitudinal direction of the noise screen.

To achieve this purpose the posts are built up by two parts 8*a* which are mutually kept together by bolts 9 (see FIGS. 1, 3, 4 and 6) which must be secured to the post profiles 8*a* in such a manner that the two profiles may freely adjust themselves in the longitudinal direction of the noise screen.

The posts 8 are secured by means of bolts to piles or bases, for example of concrete or a similar material which can be cast in the ground, as indicated in FIGS. 1, 3, 4 and 5.

The two parts 8*a* of the posts 8 are advantageously designed as two equally sized and congruent post profiles whereby the manufacture of the posts may be simplified and storage space may be saved.

Each post profile 8*a* has a plane face at right angles to the longitudinal direction of the noise screen, and at the first side edge of the plane face the post profile 8*a* is bent approx. 90° twice such that the end extends back towards the opposite side edge of the post profile substantially parallelly to the plane face and at a distance thereof. Apart from the said two bendings of the first side edge, the opposite second side edge is bent one more time such that the free edge extends away from the plane face substantially at right angles thereto.

With a view to blurring the posts as much as possible these are provided with holes 11 permitting fastening of planting wire which may form an espalier for plants, which may be planted against the noise screen.

I claim:

1. A noise screen adapted to absorb noise originating on one side of the screen, and in particular, noise coming from a direction below the noise screen, the noise screen comprising a plurality of noise absorbing elements, each noise absorbing element including.

a perforated front plate having a middle section and a bent section on opposite ends of the middle section, to, in turn, define a U-shaped region;

a non-perforated rear plate having a middle section and bent sections on opposite ends of the middle section, to, in turn, define a U-shaped region;

the non-perforated rear plate and the perforated front plate arranged with the bent sections facing each other and one bent section of each of the plates is positioned between the bent sections of the other of the plates, to, in turn, form a central cavity and opposing grooves; and a sound absorbing element positioned within the central cavity;

a plurality of noise reflecting elements, the sound reflecting elements each having two opposing edges, the plurality of noise absorbing elements and noise reflecting elements being positioned in alternating order, wherein at least one of the opposing edges of each of the noise reflecting elements being positioned within one groove of an adjacent one of the plurality of noise absorbing elements, to, in turn, form a wall having a zig-zag shaped cross-section; and at least one side post attachable to a ground surface and to at least one of the plurality of noise absorbing elements and the plurality of noise reflecting elements.

2. The invention according to claim 1 wherein each of the at least one side post includes at least two vertically extending slidably associated post profiles, to, in turn, permit slidable movement of the post profiles transverse to the ground surface, relative to each other, to compensate for expansion and contraction of at least one of the post profiles, the plurality of noise absorbing elements and the plurality of noise reflecting elements due to temperature variations.

3. The invention according to claim 1 wherein each of the plurality of noise absorbing elements and the plurality of noise reflecting elements are attached to the at least one side post.

4. The invention according to claim 1 wherein an upper end of each of the at least one side post is cut at an angle corresponding to the angle of an uppermost element of the plurality of noise absorbing elements and the plurality of noise reflecting elements.

5. The noise screen according to claim 1 wherein the grooves (4*a*, 4*b*) comprise a seal of a rubber material.

6. The noise screen according to claim 1 wherein the sound reflective element (3) comprises a transparent material.

* * * * *